United States Patent [19]

Bollen

[11] Patent Number: 4,944,471

[45] Date of Patent: Jul. 31, 1990

[54] METHOD OF PRODUCING A YARN TENSION ON A BOBBIN CREEL

[75] Inventor: Manfred Bollen, Oberuzwil, Switzerland

[73] Assignee: Benninger AG, Uzwil, Switzerland

[21] Appl. No.: 282,555

[22] Filed: Dec. 12, 1988

[30] Foreign Application Priority Data

Dec. 23, 1987 [CH] Switzerland ..... 5049/87

[51] Int. Cl.[5] ..... B65H 49/02; B65H 59/22

[52] U.S. Cl. ..... 242/131.1; 242/151

[58] Field of Search ..... 242/131.1, 131, 130, 242/130.1, 149, 150, 151, 152; 28/190, 194

[56] References Cited

U.S. PATENT DOCUMENTS

| | | | |
|---|---|---|---|
| 1,762,261 | 6/1930 | De Wolf | 242/130.1 |
| 2,133,507 | 10/1938 | Guild | 242/131.1 |
| 3,459,389 | 8/1969 | Wildi et al. | 242/131.1 X |
| 3,473,757 | 10/1969 | Cashore | 242/131.1 X |
| 3,848,829 | 11/1974 | Womer | 242/131 |
| 4,234,138 | 11/1980 | Gehring et al. | 242/131.1 |
| 4,471,917 | 9/1984 | Whisnant | 242/131.1 |
| 4,535,956 | 8/1985 | Wildi et al. | 242/151 |
| 4,538,776 | 9/1985 | Perry | 242/131 |

FOREIGN PATENT DOCUMENTS

| | | | |
|---|---|---|---|
| 709295 | 5/1954 | United Kingdom | 242/131.1 |

*Primary Examiner*—Stanley N. Gilreath

*Attorney, Agent, or Firm*—Shoemaker and Mattare

[57] ABSTRACT

In order to increase the yarn tension between a winder and a bobbin creel, the yarns are returned from a first yarn tensioner to the inlet of a second adjacent yarn tensioner in the row. The rows of bobbins which are associated with the second yarn tensioners remain without bobbins. In order to facilitate a change in direction when dealing with sensitive yarns at the second yarn tensioner, a direction-changing roller is disposed at the inlet thereof.

1 Claim, 2 Drawing Sheets

METHOD OF PRODUCING A YARN TENSION ON A BOBBIN CREEL

FIELD OF THE INVENTION

The invention relates to a method of producing a yarn tension on a bobbin creel, and in particular, for beaming or warping installations with a plurality of bobbin holding means which are arranged in rows for accommodating bobbins and with a respective yarn tensioner associated with each bobbin holding means, wherein a yarn is drawn off a bobbin and passed through the associated yarn tensioner. The invention also relates to a bobbin creel for carrying out the method.

DESCRIPTION OF THE PRIOR ART

It is known that, on beaming or warping installations, the individual yarns which are drawn off the bobbins must be braked in the region of the bobbin or creel by means of yarn tensioners in order to hold the yarns in a tensioned condition with a constant tensile force. Depending on the nature of the yarn or the distance of the bobbin from the winding, that tensile force may vary greatly so that it must be possible to adjust the desired tensile force at the yarn tensioners.

CH-A-577571 discloses a controllable yarn braking device on a warping creel in which the braking means comprise, for each yarn, a disc-type tensioner with a top disc which can be lifted off transversely relative to the direction of movement of the yarn, and a second disc tensioner with a top disc which constantly bears against the yarn. Depending on the respective tensile force desired, the disc tensioner which can be lifted off can be relieved of load by means of a control device so that the yarn tension falls. It will be seen that that arrangement involves a high level of apparatus expenditure, while the braking force is limited by the weight of the top discs themselves. However that weight cannot be increased just as may be desired as otherwise the yarn could suffer from damage.

SUMMARY OF THE INVENTION

An object of the present invention is therefore to provide a method of the kind set forth in the opening part of this specification in which the yarn tension at the bobbin creel can be considerably increased without an increase in apparatus expenditure. The setting times on the bobbin creel should be as short as possible and if possible, it should also be possible to convert already existing bobbin creels, in accordance with the features of the invention.

According to the invention, that object is achieved by arranging that the yarn, after leaving a first yarn tensioner, is returned to at least one further yarn tensioner which is adjacent in the row and the associated yarn holding means of which is not fitted with a bobbin and that the yarn also passes through the further yarn tensioner before it is fed to the winder.

According to the invention also, a bobbin creel for carrying out the above method comprises a plurality of bobbin holding means which are arranged in rows for accommodating bobbins and with a respective yarn tensioner associated with each bobbin holding means, the creel being characterised in that at their inlet and outlet the yarn tensioners have direction-changing means for the yarn, which permit a change in the direction of the yarn from the outlet of a yarn tensioner to the inlet of an adjacent yarn tensioner in the row.

By virtue of the yarns being returned to an adjacent yarn tensioner, the tensile force can be readily doubled without complicated ancillary devices being acquired for that purpose. Accessibility to the bobbin creel and to the individual yarn tensioners is fully retained and it is extremely simple to draw in the yarn. In certain circumstances it is possible for a yarn to be passed through a plurality of bobbin tensioners before leaving the bobbin creel in the direction of the winder.

The yarn can be returned to an adjacent yarn tensioner by virtue of the provision of direction-changing means at the inlet and the outlet of the yarn tensioners. The direction-changing means must be such that the yarn can be changed in direction or bent through an angle without suffering damage. In particular in that respect the yarn should not come into contact with any sharp-edged components and should not pass into the region of movable parts of the yarn tensioner.

In a particularly advantageous construction the inlet of all yarn tensioners is formed by an inlet eye. That permits the yarn to be introduced into the yarn tensioner from various directions, without giving rise to problems, more specifically either directly from the yarn balloon of the bobbin to be unwound or from the outlet of an adjacent yarn tensioner. If at least every second yarn tensioner of a row has at its inlet a rotatable direction-changing roller for the yarn, then even relatively sensitive yarns can be changed in direction in a careful manner, and thus introduced into the second yarn tensioner.

In that connection it is particularly advantageous for the direction-changing roller to be arranged at a spacing from the inlet eye in such a way that the yarn can be fed to the tensioner selectively by way of the direction-changing roller or directly by way of the inlet eye. It is possible to choose between the two alternatives when setting up the arrangement, depending on the quality of yarn, while even in the case of yarns which are strong in themselves, the direction-changing roller can be used in order somewhat to reduce the amount of friction.

The yarn tensioners may in themselves be in the form of conventional disc tensioners with discs which can be pressed against each other. In a particularly advantageous embodiment however the invention can provide that the yarn tensioners are roller tensioners with rollers which can be pressed towards each other. In that arrangement one of the two rollers of a roller tensioner serves in a particularly simple fashion as a direction-changing means for returning the yarn to the adjacent tensioner. In addition, it is precisely in the case of roller tensioners that the braking force that can be applied is limited as the two rollers cannot be pressed towards each other with just any desired force.

DESCRIPTION OF THE DRAWINGS

In order that the invention may be clearly understood and readily carried into effect, assemblies in accordance therewith will now be described, by way of example with reference to the accompanying drawings, in which.

DESCRIPTION OF PREFERRED EMBODIMENTS OF THE INVENTION

Figure 1:
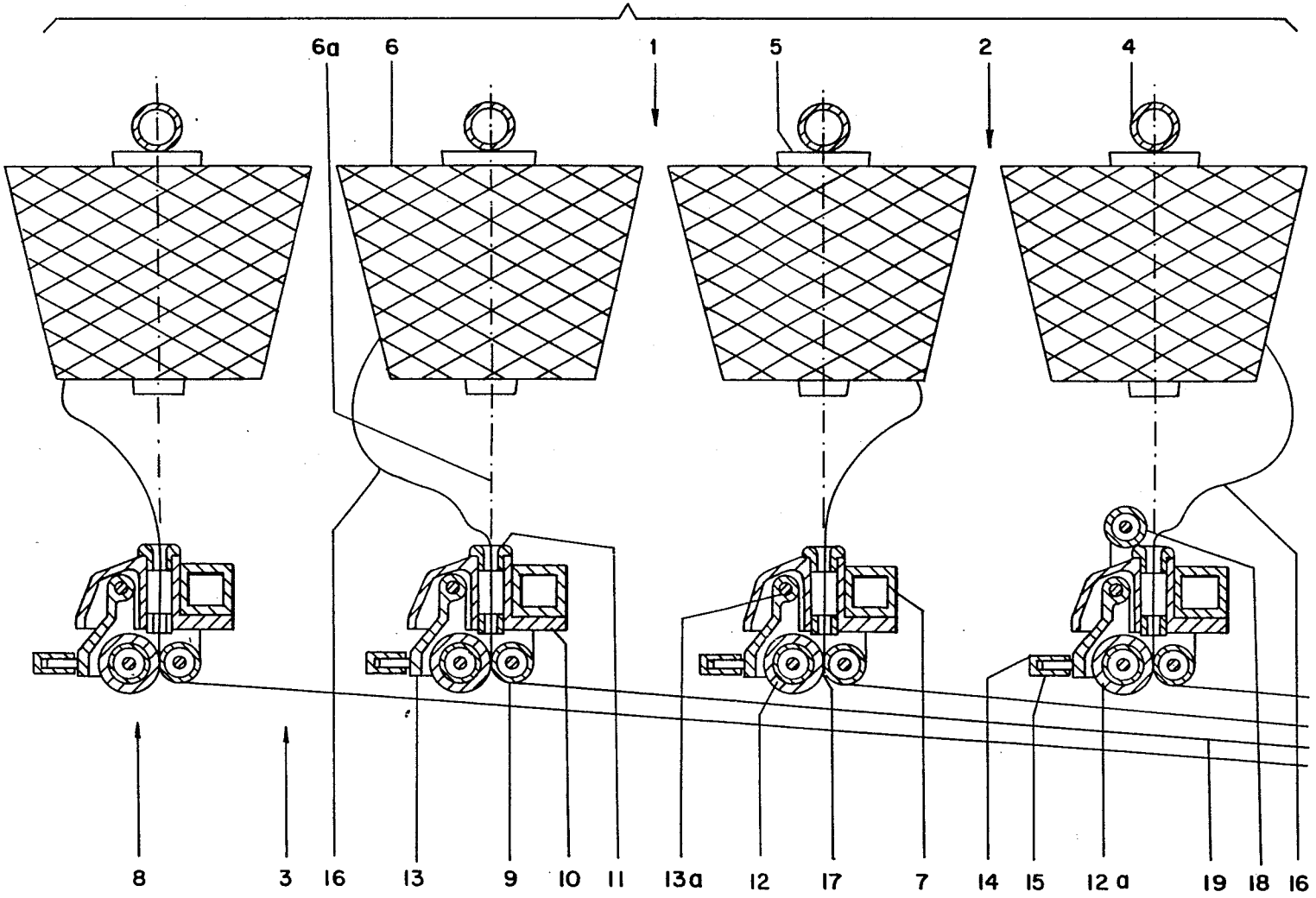
FIG. 1 is a plan view of the bobbin array and the braking array of a bobbin creel.

FIG. 1 is a view in simplified form of a section from a bobbin creel 1 which is formed by a bobbin array 2 and a braking array 3. The bobbin array 2 generally comprises perpendicularly supports 4 on which the bobbins 6 are fitted on to fixed cones 5. In that way, the individual bobbins are arranged in a substantially matrix-like arrangement, in a vertical plane. Arranged opposite the bobbin array 2 and also in a vertical plane is the braking array 3 on which roller tensioners 8 are fixed on vertical supports 7.

The roller tensioners 8 generally comprise a steel roller 9 which is mounted rotatably at a stationary location in a housing 10. The housing 10 itself is secured to the support 7 and is so arranged that the bobbin centre 6*a* is aligned horizontally and vertically with the inlet eye 11 on the housing 10.

Disposed opposite the steel roller 9 is a pressure roller 12 which is provided with a rubber cover 12*a* and which is mounted pivotably in a lever arm 13, the pivot point 13*a* also being disposed in the housing 10. A force is applied to the lever arm 13 by way of a lever 14 in a manner which is not shown in greater detail in the drawings, so that the pressure roller 12 is pressed against the steel roller 9. Secured to the lever 14 is a roller 15 which, when the lever is displaced, rolls against the lever arm 13. The action of the rubber cover 12*a* on the pressing roller 12 produces a squeezing or pressing effect which brakes the yarn 16 which is drawn off the bobbin 6, in the roll gap 17, in such a way that the desired yarn tension is produced in the taut region 19, downstream of the roller tensioners 8.

Depending on the force which is applied to the lever arm 13 and the pressing roller 12 by way of the lever 14 and the roller 15, the yarn tension in the yarn 16 can be increased or reduced, on leaving the roller gap 17. Although, when using a roller tensioner, the yarn tension produced can be varied within a very wide range, for example from at least 10 cN to 100 and more cN, higher levels of yarn tension may be required in certain situations. The pressing force on the lever arm 13 or the pressing or squeezing effect of the rubber cover 12*a* however cannot be increased to just any desired level.

Figure 2B:
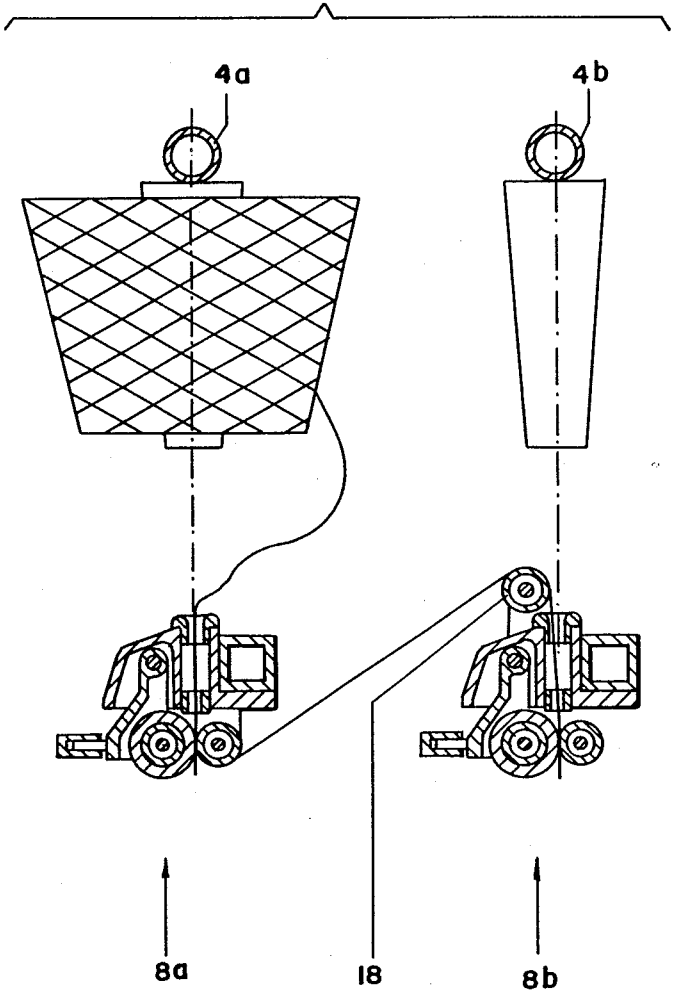
FIGS. 2*a* and 2*b* are plan views of portions of the bobbin creel shown in FIG. 1 with two different yarn paths.
Figure 2A:
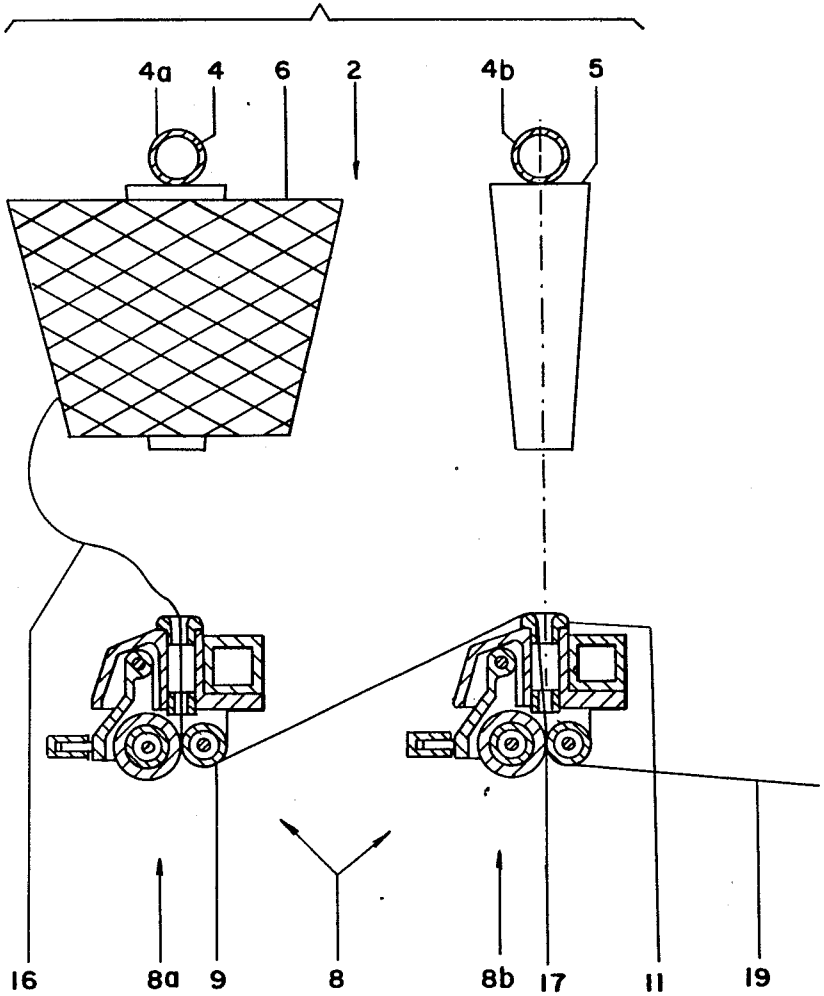

In such a case the bobbin creel shown in FIG. 1 is operated in the manner according to the invention, as shown in FIGS. 2*a* and 2*b*. In that case, only each second support 4 is equipped with a bobbin 6, in the bobbin array 2. As illustrated, the first support 4*a* receives bobbins 6 while the supports 4*b* of the second row of bobbins or the cones 5 thereof remain vacant. The yarn 16 is firstly drawn through the first roller tensioner 8*a* which is associated with the first support 4*a*. After leaving the first roller tensioner 8*a* however the yarn is not fed to the winder (not shown) but is passed back around the steel roller 9 to the inlet of the second roller tensioner 8*b* which is associated with the second support 4*b* with cones 5 which have no bobbins thereon. In that case the yarn is tensioned about the eye 11 which in this case serves as a direction-changing means. By virtue of that configuration, the tension of the yarn 16, after leaving the second roller tensioner 8*b*, is approximately doubled or is additionally increased by the amount of sliding friction in the region of the inlet eye 11 at the second roller tensioner 8*b*.

In certain situations it may not be permissible for the yarn to be guided by the eye 11 at the second roller tensioner 8*b*, as for example in the case of glass fibres. In such a situation, the yarn is changed in its direction in the manner shown in FIG. 2*b*. The second roller tensioners 8*b* are provided at their inlet with a direction-changing roller 18. The roller 18 is arranged in such a way that it guides a yarn guided thereon into the inlet eye 11 or into the roller gap 17. It is also arranged at a sufficient spacing from the inlet eye 11 so that the yarn can be guided selectively either by way of the direction-changing roller 18 or directly into the inlet eye 11. The direction-changing roller 18 may also remain on the roller tensioner 8*b* in normal operation, as shown at the extreme right in FIG. 1. In that case, however, means (not shown) are required to prevent the yarn 16 from becoming entangled with the roller 18. It would also be possible for the direction-changing roller 18 to be secured rotatably to a holding means which in normal operation can be pivoted away laterally. It will be seen that the direction-changing roller 18 provides that the yarn undergoes a change in direction at the second roller tensioner 8*b* in a careful manner with a low level of friction.

It will be seen that the yarn tension can be increased at the bobbin creel in the manner according to the invention, quickly and without complicated ancillary equipment. The operation of threading the yarn in is comparatively simple and adjustment of the yarn tension remains assured as the pressing force of the two yarn tensions 8*a* and 8*b* can still be adjusted.

I claim:

1. A method of producing a yarn tension on a bobbin creel which is associated with a winder and has a plurality of bobbin holding means arranged in rows for accommodating bobbins and associated with a respective yarn tensioner for each bobbin holding means, the method comprising drawing off a yarn from a bobbin mounted on one of said bobbin holding means in a row thereof, firstly passing said yarn through a first yarn tensioner associated with said bobbin, omitting a bobbin from further yarn holding means which is adjacent in said row, returning said yarn after leaving said first yarn tensioner to a second yarn tensioner associated with said further yarn holding means and passing said yarn through said second yarn tensioner before said yarn is fed to the winder.

* * * * *